United States Patent [19]

Mori

[11] Patent Number: 4,927,715

[45] Date of Patent: May 22, 1990

[54] OVERLAY ALLOY USED FOR A SURFACE LAYER OF SLIDING MATERIAL

[75] Inventor: Sanae Mori, Nagoya, Japan

[73] Assignee: 501 Daido Metal Company Ltd., Nagoya, Japan

[21] Appl. No.: 332,407

[22] Filed: Mar. 31, 1989

Related U.S. Application Data

[63] Continuation of Ser. No. 61,030, Jun. 11, 1987, abandoned, which is a continuation of Ser. No. 813,971, Dec. 27, 1985, abandoned.

[30] Foreign Application Priority Data

May 22, 1985 [JP] Japan ..... 60-109627
Sep. 26, 1985 [JP] Japan ..... 60-213460

[51] Int. Cl.[5] ..... F16C 33/12

[52] U.S. Cl. ..... 428/645; 428/652; 428/653; 384/912

[58] Field of Search ..... 420/570, 573; 428/645, 428/650, 652, 674, 675, 653; 384/912, 913, 492, 625

[56] References Cited

U.S. PATENT DOCUMENTS

| | | | |
|---|---|---|---|
| 2,525,887 | 10/1950 | Frazier et al. | 428/645 |
| 2,586,100 | 2/1952 | Schultz | 428/645 |
| 3,180,008 | 4/1965 | Elderkin et al. | 428/645 |
| 4,206,268 | 6/1980 | Roener et al. | 420/573 |
| 4,452,866 | 6/1984 | Kamiya et al. | 384/913 |
| 4,562,122 | 12/1985 | Hodes et al. | 428/645 |
| 4,645,360 | 2/1987 | Eastwood et al. | 384/912 |
| 4,836,695 | 6/1989 | Baureis et al. | 384/912 |

FOREIGN PATENT DOCUMENTS

| | | | |
|---|---|---|---|
| 134234 | 10/1946 | Australia | 428/645 |
| 135046 | 2/1947 | Australia | 428/645 |
| 487310 | 10/1952 | Canada | 428/645 |
| 515808 | 8/1955 | Canada | 428/645 |
| 42128 | 10/1977 | Japan . | |
| 84435 | 7/1981 | Japan . | |
| 9635 | 2/1982 | Japan . | |
| 205442 | 11/1984 | Japan | 420/570 |
| 112115 | 9/1962 | Pakistan | 420/573 |
| 832396 | 4/1960 | United Kingdom . | |
| 1117684 | 6/1968 | United Kingdom . | |
| 2060692 | 5/1981 | United Kingdom . | |

OTHER PUBLICATIONS

"Materials for Sliding Bearing", Kazuyuki Morita, *Engineer*, Sep. 1967, p. 44 with cover page.

"Recent Trend of Materials Used for Sliding Bearing", Kazuyuki Morita, *Engineer*, Apr., 1970, p. 90 with cover page.

*Primary Examiner*—John J. Zimmerman

*Attorney, Agent, or Firm*—Browdy & Neimark

[57] ABSTRACT

Herein disclosed are an overlay alloy used for surface layer of a sliding material and consisting, by weight, of Cu within the range of 0.1 to 6%, In within the range of 1 to 10% and the balance Pb and incidental impurities, and a composite sliding material comprising an surface layer consisting of said overlay alloy. The overlay alloy can further include Sn not more than 8%.

2 Claims, 2 Drawing Sheets

OVERLAY ALLOY USED FOR A SURFACE LAYER OF SLIDING MATERIAL

This application is a continuation of co-pending parent application Ser. No. 061,030, filed June 11, 1987 now abandoned itself a continuation of co-pending Ser. No. 813,971 filed Dec. 27, 1985, now abandoned.

BACKGROUND OF THE INVENTION

The invention relates to an alloy used for a surface layer of a sliding material and more specifically relates to an alloy used a surface layer of sliding material for automobile, ship, various electric equipments, OA apparatus, agricultural machinery, machine tool, food machinery, and other general industrial machinery. This invention also relates to the sliding material comprising the alloy and the manufacturing method for the sliding material.

The word "sliding material" is intended herein to mean such material as is used for a sliding part of the plane bearing and the like.

For such overlay alloys and the sliding materials there have been conventionally used such alloys as Pb-Sn alloy, Pb-In alloy, Pb-Sn-Cu alloy and Pb-Sn-In alloy and sliding materials having those alloys as surface layer, those alloys and sliding materials being, for example, shown in "Materials for sliding bearing" by Kazuyuki Morita, Engineer, Sept. 1967, page 44; "Recent trend of materials used for sliding bearing" by the same author, Engineer, April '70, pp 90; Japanese Examined Patent Publication No. 42128/1977; and U.S. Pat. No. 2605149. Japanese Examined Patent Publication No. 9635/1982 discloses a technique for making overlay alloy wherein an electroplating method having two steps of plating and a step of heat diffusion are utilized. Because of recent remarkable progress concerning automotive internal combustion engine and other industrial machinery in which higher speed and higher load become possible, conventional sliding materials for sliding parts and the like used for such machinery have caused, when constituted by the above-mentioned conventional overlay alloys, several problems including a shorter service life of bearing experienced particularly under operational conditions of high speed and high load due to insufficient lubricant film which in turn deteriorates wear resisting property, fatigue resisting property and corrosion resistance etc. Furthermore, since in a case of sliding bearing socalled cavitation erosion is inherent in which the erosion of the surface layer of a sliding bearing is caused in lubricant oil, it has also become necessary to prevent or minimize damages caused in the sliding bearing due to the cavitation erosion. Conventioinal overlay alloys such as Pb-Sn alloy, Pb-In alloy and Pb-Sn-In alloy have been not preferred due to large degree of cavitation erosion. In view of this fact, it has been desired in this technical field to obtain a sliding material having a cavitation-erosion resisting property improved in the same degree as in conventional Pb-Sn-Cu overlay alloy.

SUMMARY OF THE INVENTION

An object of this invention is to obtain PbCu-In or Pb-Cu-In-Sn overlay alloy used under a condition of high speed and high load as a surface layer of sliding material such as a material for plane bearing and the like which overlay alloy can not only reduce cavitation erosion when used in water or lubricating oil for sliding bearing but also have superior wear resisting property, superior fatigue resisting property and superior property of resisting corrosion in lubricating oil.

Another object of the invention is to obtain a sliding material having a surface layer comprising of Pb-Cu-In or Pb-Cu-In-Sn alloy.

Still another object of the invention is to obtain a method of producing the sliding material.

One overlay alloy according to the invention consists essentially, by weight, of Cu of 0.1 to 6%, In of 1 to 10%, and the balance Pb and incidental impurities. The other overlay alloy of the invention consists essentially, by weight, of Cu of 0.1 to 6%, In of 1 to 10%, Sn not more than 8%, and the balance Pb and incidental impurities.

The sliding material of the invention comprises a backing metal, copper-lead alloy layer provided on the backing metal, and a surface layer bonded to the copper-lead alloy layer, the surface layer consisting essentially, by weight, of Cu of 0.1 to 6%, In of 1 to 10%, and the balance Pb and incidental impurities. The surface layer of the sliding material according to this invention may further include Sn of not more than 8%.

Then the reasons will be described below why the composition of each constituent for the overlay alloy of this invention should be limited to the range described above.

(A) Cu: This element should be included in the range from 0.1 to 6%. A Cu content less than 0.1% causes a poor load capacity, and a Cu content not less than 0.1% has an effect of making fine the structure. On the other hand, a Cu content more than 6% causes brittle structure. A preferred composition of Cu is 1.5 to 5%. The effect of Cu within this range is to make fine the structure of the surface layer alloy, so that the load capacity can be improved and the diffusion rate of indium into the underlayer alloy can be reduced. This effect in turn brings about both a prolonged service life against corrosion and improved fatigue resisting property.

(B) In: This element should be included in a range of 1 to 10%. An In content less than 1% causes a poor corrosion resistance, while an In content more than 10% causes a poor load capacity. A preferred composition range thereof is from 2 to 9%. Indium improves both corrosion resistance and wear resisting property of the overlay alloy.

(C) Sn: This should be included in a range of not more than 8% (zero being excluded), and preferably from 0.5 to 8%. In a case of In not more than 3%, the overlay alloy may contain Sn of not less than 1% with the result that the corrosion resistance of the alloy can be improved very much because of the interaction between tin and indium, whereby the alloy can withstand oil having extreme erosive nature. However, in a case where Sn content becomes more than 8%, Sn diffuses into an underlayer if it is made of Cu-alloy with the result that Sn causes Cu-Sn reaction layer (compound layer) which is thick in thickness and is brittle. It is confirmed by experiments that a thickness not more than 3 μm regarding this reaction layer do not substantially cause any problem while a thickness more than 3 μm causes unfavorable influence to a sliding material due to its brittleness. Furthermore, even if a Ni barrier to prevent both the diffusion of Sn and the formation of the compound layer is provided between the overlay alloy and the under layer, it is not effective in achieving the prolonged fatigue service life because the melting point of the alloy is lowered. A more preferred range of Sn is from 1 to 7%.

(D) Advantageous effects obtained by a combination of Pb, Cu, and In and another combination of Pb, Cu, In and Sn: In a case where indium is added to the structure which become fine in grain size by the presence of lead and copper, the alloy shows an improved mechanical strength because of the interaction of the elements. This alloy becomes a surface layer alloy (overlay alloy) with the strongest mechanical properties as well as excellent corrosion resistance. Furthermore, by adding tin of several percents to this alloy, it becomes possible to obtain an alloy capable of resisting corrosion caused by extremely corrosive oil (for example deteriorated oil), because of the interaction effect between tin and indium. In this case, the Ni barrier is unnecessary in general, however the Ni barrier provided between the surface layer and the underlayer is effective to improve the corrosion resisting property, fatigue resisting property and service life of the alloy used under severe operating conditions.

(E) Incidental impurities: These are incidentally included in the alloy during the production thereof, and are, for example, Sb, Ni and Fe etc, the individual or total amount of such impurities being less than 0.5%.

A method of producing the overlay alloy acccording to the invention is characterized by comprising the steps of electroplating a Pb-Cu alloy layer directly on or through a layer of Ni plating on a copper-lead alloy layer having steel backing metal, electroplating on the copper-lead alloy a layer of In and a layer of Sn on the In layer or electroplating In-Sn alloy on the Cu-Pb alloy layer, and heat-treating these two or three composite layers produced by electroplating so that mutual diffusion between the constituents of composite plating layer can take place to produce Pb-Cu-In or Pb-Cu-In-Sn overlay alloy.

Referring to the thickness of the plating, (1) the electroplated thickness of Pb-Cu alloy layer is within a range from 5 to 100 μm, and (2) the electroplated thickness of both the In and Sn layers or the In-Sn alloy layer should be within the range from 1 to 20 μm, so that the total thickness of the composite electroplated layers (1) and (2) is within the range from 6 to 120 μm.

The diffusion heat-treatment of the composite electroplated layers is carried out for 10 minutes to 20 hours at a temperature range from 80° to 180° C.

The copper-lead alloy layer bonded to the backing metal may be provided by sintering the powder of the copper-lead alloy or by roll-pressure-bonding the copper-lead alloy sheet laid on the backing metal or by explosive-forming the copper-lead alloy sheet laid on top of the backing plate.

DESCRIPTION OF THE PREFERRED EMBODIMENTS

Figure 1:
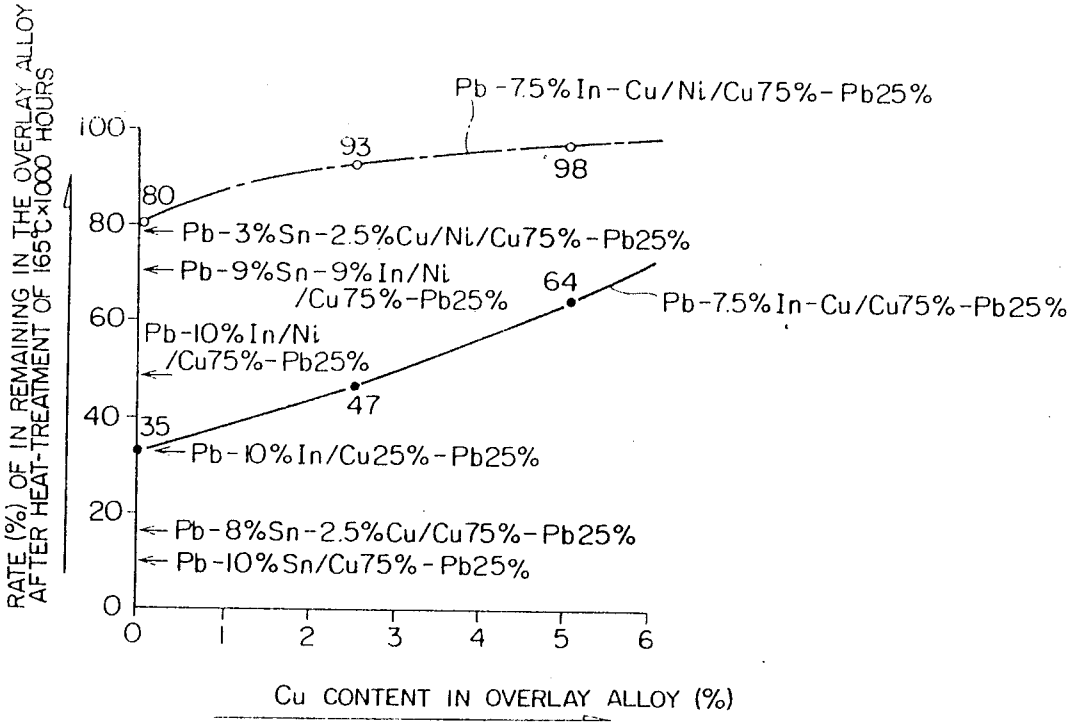
FIG. 1 is a graph showing the relationship between C content of overlay alloy and In content remaining in the overlay alloy after the heat-treatment.

The preferred embodiments of this invention will be described hereinafter.

A semicylindrical plane bearing with three or four layers was made in the following procedure. First the copper-lead alloy powder (consisting by weight of Pb between 20 and 40%, Sn not more than 1%, Ni not more than 2%, and the balance Cu) of about 1 to 2 mm thickness was disposed onto a usual structural carbon steel backing metal of 1.24 mm thickness which backing metal has an electroplated copper layer of about 5 μm. Then, the copper-lead powder was sintered by passing it through a furnace at about 820° C in a reducing atmosphere. The sintered porous copper-lead alloy layer was passed through rolls to reduce the thickness thereof into a range from 0.4 to 0.8 mm. Then this composite material was formed by a press machine into a semicylindrical member so that the Cu-Pb alloy layer faces radially inwardly. The electroplating of Pb-Cu alloy was subsequently applied directly onto the inner peripheral surface of the semicylindrical member or onto an electroplated Ni layer 1 to 5 μm thickness having previously been provided on the inner peripheral surface of the semicylindrical member by use of both a Pb-Cu alloy plating bath having compositions shown in Table 1 and electroplating conditions shown in Table 2. Next, an electroplating of In, or a combination of an electroplating of In and another electroplating of Sn onto In, or an electroplating of In-Sn alloy is applied onto the Pb-Cu electroplating layer by use of a conventional plating bath described, for example, in "Handbook of Bearing Lubrication" published by Nikkan Kogyo Shinbunsha, June 30, '61, Pages 367–368 and Pages 432–438. Subsequent to this step, such heat-treatment as holding the composite member within a temperature range from 80° to 180° C. in a period of time from 10 minutes to 20 hours was effected, whereby semicylindrical plane bearings with three or four layers of alloys were obtained. The thickness of the surface layer alloys (that is, overlay alloys) was 10 to 20 μm.

TABLE 1

| The composition of electroplating bath for Pb—Cu Alloy | |
|---|---|
| Lead fluoborate (Pb g/l) | 60–150 |
| Copper fluoborate (Cu g/l) | 1.0–5.0 |
| Fluoboric acid (g/l) | 20–120 |
| Boric acid (g/l) | 0–35 |
| Additives (resorcin, hydroquinon and catechol, etc.) (g/l) | 1–6 |

TABLE 2

| Conditions for electroplating | |
|---|---|
| Temperature of Electroplating bath (°C.) | 15–45 |
| Cathode current density $D_K$ (A/dm$^2$) | 1.0–6.0 |
| Stirring | moderate to intensive |
| Anode is lead, Cu being additionally supplied in the form of liquid or copperoxide or basic copper carbonate. Anode current density | 0.5–5.0 |

TABLE 2-continued

| Conditions for electroplating |
|---|
| $D_A$ (A/dm$^2$) |

The sintered layer of copper-lead may be replaced by the sintered layer of Cu-based alloys, Al-Sn based alloys, Al-Si based alloys, Al-Zn based alloys or Al-Pb based alloys. Furthermore, tne Ni layer may be replaced by Cu layer of a thickness from 1 to 5 μm. The Cu or Ni layer may be provided by a strike plating method. Although in the above-mentioned embodiment the copper-lead alloy layer was provided by sintering method, a method of centrifugal casting may be alternatively employed to provide copper-lead alloy layer or white metal bearing alloy layer on the inner face of the cylindrical steel backing metal.

The Cu-Pb alloy layer or Al based alloy layer may be provided by steps of overlapping steel backing metal and Cu-Pb alloy each other and pressure-bonding the overlapped material through rolls. The overlapped material may be alternatively subjected to an explosive forming to obtain a semicircular composite member, on the inner peripheral surface of which composite member the overlay alloy embodying the present invention may be applied by the electroplating described above.

In a conventional Pb-Sn alloy electroplating method there is caused a plated surface having relatively large roughness. Further, the conventional Pb-Sn-Cu alloy electroplating is also apt to cause rough deposites. Furthermore, in the conventional Pb-Sn or Pb-Sn-Cu alloy electroplating, both the state of surface obtained thereby and electrodeposited composition are apt to vary due to the variation of additives. In an electroplating bath used for the above-mentioned conventional Pb-Sn or Pb-Sn-Cu alloy electroplating there is included $Sn^{+}$ which is apt to be oxidized into $Sn^{+4}$ because of the existence of both the soluble oxygen and $Cu^{+2}$ in the plating bath which $Sn^{+4}$ can not be electrodeposited. If the content of $Sn^{+4}$ is excessive, the electroplating bath becomes muddy into white color and the composition of the bath separates while causing the electroplated layer to be brittle. Further, the presence of $Cu^{+2}$ in the plating bath also causes an accelerated change of $Sn^{+2}$ to $Sn^{+4}$ thus making the plating bath unstable, with the result that the plating process itself will not be continued unless this $Sn^{+4}$ is removed by sedimentation or the plating bath is renewed.

According to the electroplating process according to the present invention, however, the plating bath can be used for a much longer period of time in comparison with the conventional Pb-Sn or Pb-Sn-Cu electroplating because the bath of Pb-Cu alloy electro-plating is very stable. Further, it was possible to continue the electroplating while removing not only dust adhered to both plating jigs and materials to be treated but also impurities caused during electroplating by filtering them through activated carbon, in the case of the method of the present invention. Further, in the present invention a dense and specular gloss plated layer (surface) was obtained.

In the embodiment described above, the surface layer of the Pb-Cu-In alloy or Pb-Cu-In-Sn alloy was formed directly on the underlayer of the Cu-Pb bearing alloy or on a diffusion-minimizing layer of Ni, etc. provided on the underlayer. Alternatively, Al-based bearing alloys such as Al-Zn alloy, Al-Sn alloy and etc. are available as the underlayer, in place of Cu-Pb alloy. When effecting the process of the invention by use of the Al-based bearing alloy, alkaline-etching was effected onto the Al-based bearing alloy, and then the plating of Cu, Cu-Zn, Cu-Sn, Sn or Ni was effected to form the underlayer, onto which the Pb-Cu-In alloy or Pb-Cu-In-Sn alloy was formed. In this case, even when the surface roughness is in the range of 3–5 μm after the alkaline-etching, it was possible to obtain a surface layer of such superior leveling as in 0.1–0.8 μm by use of the process of the invention.

The Pb-Cu bath is very stable as explained above, an alkaline Sn bath and an In bath being also stable to thereby make it possible to use the bathes continuously, so that the production of Pb-Cu-In and Pb-Cu-In-Sn alloys can be stably produced in the present invention by use of the combination of the stable baths.

In Table 3 there are shown the data of the overlayalloys for sliding material made by using the method according to the present invention together with the data of conventional overlay alloy with respect to their compositions, mechanical properties, corrosion losses and thicknesses of reaction layer for the underlayer. It is obvious from Table 3 that the overlay alloys of the present invention have the values of hardness, tensile strength and load capacity all higher than those of the conventional overlay alloys according to the prior art. In a case of the present alloy, when the content of Cu increases to 5%, the elongation of overlay alloy become small. Thus, a Cu content of 6% or more will cause the alloy to be brittle. Regarding the corrosion loss due to degraded oil, when there is no Ni-barrier, corrosion of conventional alloy samples subjected to the heat-treatment of 165° C.×1000 hours is remarkable due to the diffusion of Sn or In into an underlayer with the exception of the Pb-Sn-In alloy. On the other hand, the overlay alloy of the present invention has proved to have very small corrosion loss approximately from one fourth to one sixth that of the conventional alloy. Among the present alloys a Pb-Cu-In-Sn alloy shows a particularly superior corrosion resistance. Although in the present invention the thickness of a reaction layer of intermetallic compound caused by the reaction between In and Sn is advantageously small, the reaction layer thickness becomes large when Sn content is excessive. If this reaction layer exceeds 3 μm in thickness, the resulting overlay alloy becomes brittle and deteriorates regarding fatigue strength. It is believed that the improved corrosion resistance of the present alloy is owing to the addition of Cu element, as shown in FIG. 1, which reduces diffusion of In into the underlayer alloy. By providing a Ni-barrier between the underlayer and the overlay alloys, it is possible to reduce the corrosion loss very much, thus capable of obtaining a good corrosion resistance. FIG. 1 and Table 3 also show the fact that even without such Ni-barrier a value of corrosion resistance employable for practical use can be obtained by the addition of a predetermined content of Cu into the overlay alloy which Cu functions to reduce the diffusion of In and to increase the remaining ratio of In in the surface layer alloy.

TABLE 3

Composition, mechanical properties[3], and corrosion loss of the overlay alloy tested and the thickness of the reaction layer caused by the reaction between underlayer and overlay alloy

| | Composition of overlay alloy (wt %) | | | | Micro Vickers hardness at 10 gram | Tensile strength | Elongation | Corrosion loss[1] with Ni mg/cm² | Corrosion loss[1] without Ni mg/cm² | Thickness of reaction layer[2] (μm) |
|---|---|---|---|---|---|---|---|---|---|---|
| | Pb | Cu | In | Sn | | | | | | |
| Typical conventional alloys | Balance | — | — | 10 | 9.2 | 3.2 | 22.4 | 1> | 16.0 | 5.7 |
| | " | — | 10 | — | 10.3 | 3.0 | 18.1 | " | 19.3 | 1.8 |
| | " | 2.5 | — | 8 | 12.3 | 4.4 | 20.0 | " | 19.2 | 5.7 |
| | " | — | 9 | 9 | 10.8 | 3.3 | 22.7 | " | 1> | 5.7 |
| Overlay alloys according to the present invention | " | 1.5 | 3 | — | 14.5 | 4.7 | 22.9 | 1> | 3.9 | 1.0 |
| | " | 3.0 | 3 | — | 18.8 | 5.6 | 23.0 | " | 3.4 | 0.7 |
| | " | 5.0 | 3 | — | 24.4 | 5.4 | 16.5 | 1.9 | 3.0 | 0.6 |
| | " | 1.5 | 6 | — | 13.6 | 4.9 | 21.4 | 1> | 2.5 | 1.7 |
| | " | 3.0 | 6 | — | 17.8 | 5.9 | 20.0 | " | 2.2 | 1.5 |
| | " | 5.0 | 6 | — | 23.6 | 5.7 | 13.9 | " | 1.8 | 1.4 |
| | " | 1.5 | 9 | — | 12.8 | 5.1 | 19.8 | " | 1.9 | 1.4 |
| | " | 3.0 | 9 | — | 17.1 | 6.2 | 17.0 | " | 2.0 | 1.7 |
| | " | 5.0 | 9 | — | 22.9 | 6.1 | 11.6 | " | 2.3 | 1.8 |
| | " | 1.5 | 3 | 1 | 14.0 | 4.6 | 21.5 | " | 1> | 1.0 |
| | " | 3.0 | 3 | 5 | 15.4 | 5.4 | 22.0 | " | " | 2.0 |
| | " | 5.0 | 9 | 7 | 19.2 | 5.6 | 12.0 | " | " | 2.4 |

Figure 2:
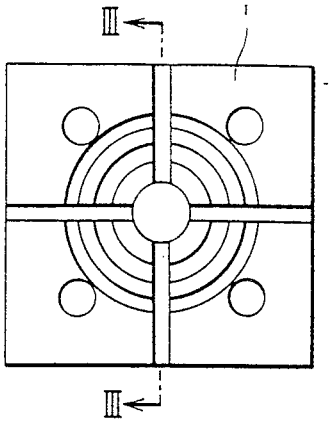
FIG. 2 shows a front view of a test piece used for seizure test.
Figure 3:
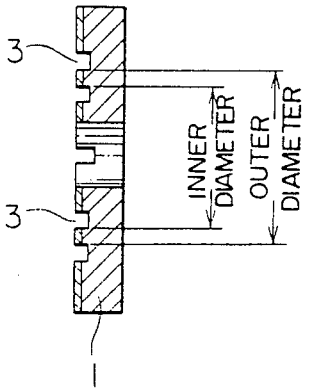
FIG. 3 shows a cross-sectional view taken along the line III—III of FIG. 3.
Figure 4:
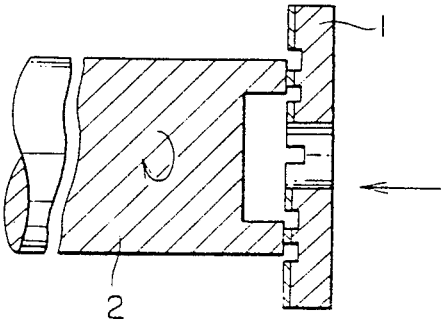
FIG. 4 shows the manner of the seizure test.

The present sliding material was next examined regarding its seizure characteristic and wear amount by using the so-called Suzuki tester. The conditions for the test were as follows (FIGS. 2 to 4 show the shape and state of the test piece (1)).

The material for the shaft (2): S45C

Lubricant: SAE 30#, coated by an amount of 0.02 ml on the test piece when assembled into the tester Revolution of the shaft: 780 rpm Dimension of the test piece: The test piece has a ring shaped groove (3) having 27.2 mm in outer dia., 22 mm in inner dia. and 1 mm in thickness. The underlayer material consists of an Cu 75% - Pb 25% alloy with a steel backing metal, the total thickness of the backing metal and the Cu-Pb alloy being 1.5 mm. An overlay alloy having 10 μm thickness was provided on the underlayer alloy by means of electroplating.

The period for the test: 70 min.

Table 4 shows the value of seizure load and the average value of wear thickness respectively obtained under a lubricating condition in which only a droplet of oil (0.02 ml) was applied onto the test piece when installed. As understood from the table, the sliding material comprising an overlay alloy according to the present invention has a high seizure load, i.e. an improved seizure property, as well as a small wear thickness both of which are advantageous for the sliding material.

Then, a fatigue testing machine having a sapphire type tester was used to examine fatigue resisting property of the sliding material having an overlay alloy provided by the method according to the present invention. Test conditions were as follows:

Material of the shaft: S55C (shaft dia. being 53 mm)

TABLE 4

Average seizure load and wear depth for various overlay alloys

| | No. | Component of overlay alloy | Seizure load $\bar{x}$ (kg/cm²) | wear depth $\bar{x}$ (μm) |
|---|---|---|---|---|
| Materials used for comparison | 1 | Pb—10%Sn | 142 | 5.5 |
| | 2 | Pb—10%In | 130 | 5.9 |
| | 3 | Pb—8%Sn—25%Cu | 156 | 4.2 |
| | 4 | Pb—9%Sn—9%In | 150 | 6.2 |
| Materials according to the present invention | 5 | Pb—5%Cu—6%In | 190 | 3.0 |
| | 6 | Pb—2.5%Cu-6% In—1%Sn | 180 | 3.5 |

Test bearing: A connecting rod comprising an underlayer of Cu-Pb alloy (Cu75%-Pb25%) with steel backing metal, and an electroplated (15 μm) overlay alloy of various alloys shown in Table 5, the dimension of the bearing being 56.0 mm in outer dia., 1.5 mm in thickness and 26.0 mm in width.

Lubricant and its operating temerature: SAE#, 90° C.

Revolution; 3250 rpm

Test period of time; 20 hours and

Test load; 1330 kg/cm²

As apparent from Table 5, no fatigue cracking occurs in the alloy of the present invention, while slight fatigue cracking caused in the Pb-5%Cu-6%In-1%Sn alloy was due to a partial breakage of the underlayer.

TABLE 5

Result of fatigue test

| | Component of overlay alloy | Evaluating point 1 2 3 4 5 | Evaluating method (area) |
|---|---|---|---|
| Comparison materials | Pb-10% Sn | ←·→ | 1: Fatigue cracking area of not less than 50% |
| | Pb-10% In | ←·→ | |
| | Pb-8% Sn-2.5% Cu | ←·→ | |
| | Pb-9% Sn-9% In | ←·→ | 2: 15-50% |
| The present invention | Pb-2.5% Cu-6% In | · | 3: 5-15% |
| | Pb-5% Cu-6% In-1% Sn | ← underlayer | 4: Not more than 5% |
| | | | 5: Without fatigue |

TABLE 5-continued

| Component of overlay alloy | Result of fatigue test: Evaluating point 1 2 3 4 5 | Evaluating method (area) |
|---|---|---|
| | | crack |

Then, an engine test was effected three times in repetition number for sliding materials comprising the overlay alloy of the present invention. The test conditions were as follows:

Test machine; 35 Hp engine for two-wheeled vehicle
Shaft revolution; 13000 rpm
Shaft diameter; 33 mm
Shaft material; S50C
Test period of time: 10 hrs
Lubricant; SAE 20#
Lubricant temperature: 145°–150° C.
Test load: full engine power
Tested bearing: This has the dimension of 36.0 mm in outer dia., 1.5 mm in thickness, 13.8 mm in width, and comprises one of the overlay alloys shown in Table 6 and having 15 μm thickness which was provided by means of electroplating on the intermediate Ni-barrier which had been electroplated onto the underlayer part [Cu-Pb sintered alloy (Cu-75%-Pb-25%) with a steel backing metal].

As can be seen in Table 6, the overlay alloy of the present invention proved to be very durable against fatigue without causing no fatigue cracking.

TABLE 6

| | Component of overlay alloy | Result of engine test: Evaluating point 1 2 3 4 5 | Evaluating method (area) |
|---|---|---|---|
| Comparison materials | Pb-10% Sn | ←·→ | 1: Fatigue cracking area of not less than 50% |
| | Pb-10% In | ←·→ | |
| | Pb-8% Sn-2.5% Cu | ←·→ | |
| | Pb-9% Sn-9% In | ←·→ | 2: 15–50% |
| Materials according to the present invention | Pb-1.5% Cu-6% In | · | 3: 5–15% |
| | Pb-5% Cu-6% In-1% Sn | · | 4: Not more than 5% |
| | | | 5: Without fatigue cracking |
| | | | This evaluation was performed by microscopic examination of 15 magnifications |

As apparent from Table 7, the sliding materials of the present invention were proved to be superior to the conventional one with respect to the bonding strength between the overlay alloy and the underlayer (Ni). Regarding the characteristics of sliding material having overlay alloy of the present invention, there are shown the comparison data in Table 7 which shows the relationship between the conditions of heat treatment and the bonding strength The comparison data was made according to the methods shown in British Patent No. 2121547 and U.S. Pat. No. 4501154. As can be seen in Table 7, the overlay alloy of the present invention shows the strongest bonding strength, a minimum variation of the strength being caused due to the variation in heat-treatment temperatures, and the substantial stability being shown during the heattreatment up to 165° C.×1000 hrs. In contrast with this, the conventional overlay alloys such as P10 (Pb-10%Sn) and P9 (Pb-9%Sn-9%In) showed disadvantageously large variation in bonding strength In judging from this fact, it is apparent that the overlay alloys of the present invention (Pb-Cu-In alloy and Pb-Cu-In-Sn alloy) is superior.

Referring further to a comparison test of surface roughness of the alloys, it was confirmed that, regarding the common underlayer metal (Ni) having a surface roughness value of 0.5 to 3 μm, the conventional overlay alloys cause surface roughness between 2 and 7 μm, while the sliding material comprising overlay alloy of the present invention brings about surface roughness value of 0.6 μm. That is, the surface roughness obtained in the present invention is from one third to one eleventh smaller than that of the conventional overlayer, thus resulting in a smooth appearance.

The method according to the present invention brings about the following two advantages:

(1) Because of its very stable nature of the electroplating bath of Pb-Cu alloy employed in the present method, when compared with the conventional one of Pb-Sn or Pb-Sn-Cu alloy, the method of the invention not only makes it readily possible to be used continuously but also makes it possible to operate the plating process continuously by using charcoal filter; and (2) The method always brings about fine plating surface having specular gloss (for example, even with an underlayer having surface roughness varying from 3 to 5 μm the finished overlay alloy becomes of very good leveling and can have a very good surface roughness between 0.1 and 0.8 μm).

TABLE 7

| Semicylindrical bearing | | Heat-treatment temp. (°C.) | Heat-treatment period of time (H) | Bonding strength (kg/mm²) 0 1 2 3 4 5 6 7 8 |
|---|---|---|---|---|
| | | Heat-treatment period of time | | |
| | P9/Ni/KS25** | 145, 165 | × STD H<br>× 150 H<br>× 300 H<br>× 1000 H | 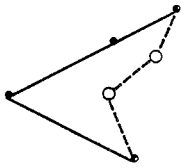 |
| | P9/Ni/KS25** | 145, 165 | × STD H<br>× 150 H<br>× 300 H<br>× 1000 H | 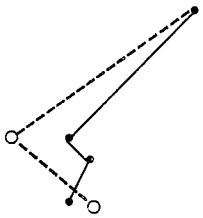 |
| Conventional one | Pb-In5***/Ni/KS25 | 145, 165 | × STD H<br>× 150 H<br>× 300 H<br>× 1000 H | 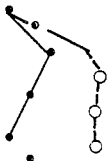 |
| | Pb-In7.5/Ni/KS25 | 145, 165 | × STD H<br>× 150 H<br>× 300 H<br>× 1000 H | 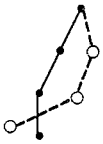 |
| | Pb-Cu25-In3.5/Ni/KS25 | 145, 165 | × STD H<br>× 150 H<br>× 300 H<br>× 1000 H | 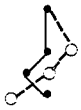 |
| The present invention | Pb-Cu2.5-In5/Ni/KS25 | 145, 165 | × STD H<br>× 150 H<br>× 300 H<br>× 1000 H | 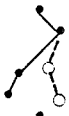 |
| | Pb-Cu2.5-In7.5/Ni/KS25 | 145, 165 | × STD H<br>× 150 H<br>× 300 H<br>× 1000 H | 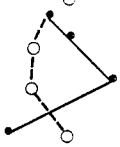 |
| | P8/Ni/KS25**** | 145, 165 | × STD H<br>× 150 H<br>× 300 H<br>× 1000 H | 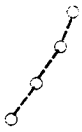 |
| Conventional one | Pb-Sn5-Cu3/Ni/KS25 | 145, 165 | × STD H<br>× 150 H<br>× 300 H<br>× 1000 H | 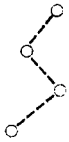 |

TABLE 7-continued

| Semicylindrical bearing | | Heat-treatment temp. (°C.) | Heat-treatment period of time (H) | Bonding strength (kg/mm²) 0 1 2 3 4 5 6 7 8 |
|---|---|---|---|---|
| | Pb-Cu5-In7.5/Ni/KS25 | 145, 165 | × STD H, × 150 H, × 300 H, × 1000 H | |
| The present invention | Pb-Cu5-In10/Ni/KS25 | 145, 165 | × STD H, × 150 H, × 300 H, × 1000 H | |

μ = 1-6
145° C.
165° C.

Notes in Table 7:
*The expression P10/Ni/KS25 means that the bearing comprises a steel layer, a Kelmt sintering layer, a Ni plating layer, and a Sn10 % - Pb plating layer i.e. the bearing being formed by the steps of applying a Ni-plating layer onto the semicircular inner peripheral surface of the KS25 and applying the P10 plating (Sn10 % - Pb alloy plating) layer. Kelmt is a bronze metal including 25% of Pb.
**P9 is a plating layer of In9 % - Sn10 % - Pb alloy.
***In5 means that In is included by the amount of 5 wt %.
****P8 is a plating layer of Sn8 % - Cu3 % - Pb alloy.

Referring now to the cavitation test of the overlay alloy of various kinds, the test was conducted under the following conditions:

Test piece; This was prepared by first providing a KS25 metal part with a 50×50×1.5 mm size, then applying Ni plating layer of 1.5 μm in thickness thereon and applying a further plating layer of an alloy selected from the group consisting of Pb5%In, Pb-10%Sn, Pb-10%Sn-9%In, Pb-10%Sn-2.5%Cu and Pb2.5%Cu-6%In by the amount of 18 μm thickness onto the Ni layer.

Ultrasonic device; This has an output of 600 W with 19 KHz frequency, the energy density at the horn apex area (35 mm in dia.) being 62.4 W/cm² at 19 KHz.

Figure 5:
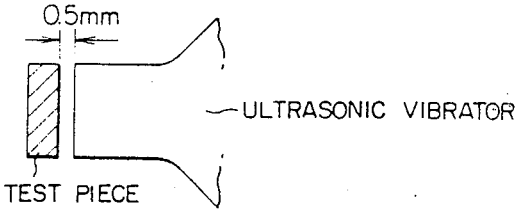
FIG. 5 shows a schematic view illustrating the manner of a test for evaluating cavitation erosion of the alloy.

Impact condition; The ultrasonic horn was arranged in the water having a temperature in the range of 15° to 20° C. so that there is a clearance of 0.5 mm between the test piece and the horn, the test period of time being one minute. The state of the test is shown in FIG. 5. The test result is shown in Table 8.

As shown in Table 8, the elements of Cu, Sn and In are effective for reducing the cavitation erowsion, the copper being the most effective element for reinforcing Pb.

In the production method of overlay alloy according to the present invention, since the electroplating bath for Pb Cu alloy is very stable, the bath can be used continuously, with the result that the process itself can be operated continuously. Moreover, as apparent from the results shown in the embodiment, the present invention can provide such an alloy having excellent properties as can be used for the overlay alloy of sliding parts or plane bearings. More specifically the alloy of the invention can realize a drastically smaller amount of cavitation erosion than those of conventional overlay alloys such as Pb-Sn, Pb-I and Pb-Sn-In. The cavitation erosion resisting property of the overlay alloy of the invention is of the same degree as in conventional Pb-Sn-Cu overlay alloy, whereby the objects of the invention can be achieved successfully.

TABLE 8

| Cavitation erosion of various overlay alloys (rate of volume loss) | | | | | |
|---|---|---|---|---|---|
| | Conventional | | | | The present invention |
| Kinds of Overlay alloy | Pb—5In | Pb—10Sn | Pb—10Sn —9In | Pb—10Sn —2.5Cu | Pb—2.5Cu —6In |
| Test Period of time (1 min.) | 63.6% | 43.9% | 15.6% | 1.5% | 1.5% |

What is claimed is:

1. A composite sliding material comprising a backing metal, a layer of bearing alloy bonded to said backing metal, a bonding layer above said layer of bearing alloy, and a surface layer bonded to said bearing layer through said bonding layer, said bearing alloy being selected from the group consisting of Al-Zn alloy and Al-Si alloy, said bonding layer being selected from the group consisting of Cu and Cu-Zn, and said surface layer being an alloy consisting essentially of, by weight, 0.1-6% Cu, 1-10% In, and the balance Pb and incidental impurities.

2. A composite sliding material according to claim 1 wherein said alloy of said surface layer comprises 1.5-5% Cu and 2-9% In.

* * * * *